US006761116B2

(12) United States Patent
Daoud

(10) Patent No.: US 6,761,116 B2
(45) Date of Patent: Jul. 13, 2004

(54) CONSTANT OUTPUT HIGH-PRECISION MICROCAPILLARY PYROTECHNIC INITIATOR

(75) Inventor: Sami Daoud, Bedford, NH (US)

(73) Assignee: Textron Sytems Corporation, Wilmington, MA (US)

( * ) Notice: Subject to any disclaimer, the term of this patent is extended or adjusted under 35 U.S.C. 154(b) by 0 days.

(21) Appl. No.: 10/121,473

(22) Filed: Apr. 12, 2002

(65) Prior Publication Data

US 2003/0070575 A1 Apr. 17, 2003

(Under 37 CFR 1.47)

Related U.S. Application Data

(63) Continuation-in-part of application No. 09/981,038, filed on Oct. 17, 2001, now Pat. No. 6,672,215.

(51) Int. Cl.[7] ..... F42C 19/12

(52) U.S. Cl. ..... 102/202.14; 102/202.7; 102/202.9; 102/530; 280/741

(58) Field of Search ..... 102/202, 202.5, 102/202.6, 202.7, 202.8, 202.9, 202.11, 202.14, 204, 380, 430, 439, 440, 470, 472, 530, 531; 280/741

(56) References Cited

U.S. PATENT DOCUMENTS

| | | | | |
|---|---|---|---|---|
| 3,059,576 A | * | 10/1962 | Haefner | 102/202.14 |
| 4,402,269 A | | 9/1983 | Smith | 102/202.13 |
| 4,464,989 A | * | 8/1984 | Gibson et al. | 102/202 |
| 4,527,481 A | * | 7/1985 | Evans et al. | 102/204 |
| 4,734,265 A | | 3/1988 | Nilsson et al. | 422/165 |
| 4,913,052 A | | 4/1990 | Hoerr et al. | 102/202 |
| 5,131,679 A | | 7/1992 | Novak et al. | 280/736 |
| 5,221,109 A | | 6/1993 | Marchant | 280/736 |
| 5,241,910 A | | 9/1993 | Cunningham et al. | 102/530 |
| 5,269,560 A | | 12/1993 | O'Laughlin et al. | 280/736 |
| 5,335,653 A | | 8/1994 | Blomqvist et al. | 128/204.18 |
| 5,403,036 A | | 4/1995 | Zakula et al. | 280/741 |
| 5,454,320 A | | 10/1995 | Hilden et al. | 102/202.7 |
| 5,556,132 A | | 9/1996 | Sampson | 280/741 |
| 5,558,366 A | | 9/1996 | Fogle et al. | 280/736 |
| 5,576,509 A | | 11/1996 | Refouvelet et al. | 102/202.7 |
| 5,634,660 A | * | 6/1997 | Fink et al. | 280/741 |
| 5,732,634 A | | 3/1998 | Flickinger et al. | 102/202.5 |
| 5,763,027 A | | 6/1998 | Enders et al. | 428/34.7 |
| 5,772,243 A | | 6/1998 | Green et al. | 280/741 |
| 5,803,492 A | * | 9/1998 | Rink et al. | 280/741 |
| 5,831,204 A | | 11/1998 | Lübben et al. | 102/318 |
| 6,105,503 A | * | 8/2000 | Baginski | 102/202.5 |
| 6,205,927 B1 | * | 3/2001 | Findley | 102/472 |
| 6,298,784 B1 | * | 10/2001 | Knowlton et al. | 102/205 |
| 6,305,286 B1 | * | 10/2001 | Fogle, Jr. et al. | 102/202.5 |

FOREIGN PATENT DOCUMENTS

| | | | | |
|---|---|---|---|---|
| DE | 2355255 | * | 5/1975 | 102/472 |

OTHER PUBLICATIONS

Park, et al., "Reaction Intermediate in Thermal Decomposition of 1,3–Disilabutane to Silicon Carbide on Si(111) Comparative Study of Cs+ Reactive Ion Scattering and Secondary Ion Mass Spectrometry", Jan. 5, 2000, pp. 117–125.

* cited by examiner

*Primary Examiner*—Harold J. Tudor
(74) *Attorney, Agent, or Firm*—Mills & Onello, LLP

(57) ABSTRACT

A high-precision pyrotechnic initiator is well adapted for rapid, precise ignition of solid and liquid energetics. A rigid housing, for example formed of an SiC-treated semiconductor substrate material, contains a pyrotechnic. When ignited, the reaction, or explosion, of the pyrotechnic is confined to the housing. The release of energy creates a hot particulate in which the formation of solid byproducts is mitigated or eliminated. The flame is directed through an outlet. In one embodiment, a microcapillary tube may be placed in communication with the outlet, the tube including a primary front vent and secondary side vents, which serve to increase system efficiency and reliability. A dual bridge wire may be provided for improving system reliability. The resulting assembly thereby performs the combined functions of both an igniter and a flash tube and a complete ignition train is provided in a manner that overcomes the limitations of the conventional configurations.

46 Claims, 4 Drawing Sheets

CONSTANT OUTPUT HIGH-PRECISION MICROCAPILLARY PYROTECHNIC INITIATOR

RELATED APPLICATIONS

This application is a continuation-in-part application of U.S. Ser. No. 09/981,038, filed Oct. 17, 2001, now U.S. Pat. No. 6,672,215, the content of which is incorporated herein by reference.

BACKGROUND OF THE INVENTION

A pyrotechnic initiator converts an electrical signal into a controlled output flame. A primer generates a flash and a booster pellet converts the flash into a controlled burn that is provided at an outlet. The flame performs a function, for example ignition of a volume of solid, liquid, or gas propellant.

Current ignition systems, for example as disclosed in U.S. Pat. No. 5,588,366, are designed to ignite solid propellants. In such systems, the reaction generally results in an explosion that is difficult to precisely control, leading to variability in the outcome. When the pyrotechnic is initiated, the outlet region of the propellant chamber disintegrates under the force of the reaction, and the resulting byproducts interfere with the flame. Consequently, the ignition is generally erratic and unpredictable, and therefore burning of the propellant is difficult to control in a repeatable fashion.

With the advent of liquid and gel propellants that have the potential for a more consistent reaction, designers are finding that contemporary chemical ignition systems are inadequate for providing the level of precision required to take full advantage of the advantageous properties of the liquid and gel propellants. Liquid and gel propellants are commonly contained in a reservoir prior to combustion by the igniter in a reaction chamber. For liquid and gel propellants, the igniter performs two functions: displacement of a regenerative piston to initiate propellant injection; and generation of hot, high-pressure gas to ignite the cold liquid/gel propellant as it enters the combustion chamber. The parameters of interest are the rate of rise in pressure (i.e., mass and energy fluxes), the maximum pressure, and the duration of the igniter. Such parameters are tailored to the characteristics of the injection piston and the liquid/gel propellant reservoir, in order to ensure that the reservoir pressure is greater than the reaction chamber pressure when the injector opens. Due to their poor flame distribution, conventional initiators are inadequate for operation with liquid and gel propellants. As a result, designers resort to laser ignition technology, which is highly accurate, but, due to the complex nature of the technology, tends to be cumbersome and expensive, and therefore does not lend itself well to high-volume applications.

SUMMARY OF THE INVENTION

The present invention is directed to a high-precision pyrotechnic initiator well adapted for rapid, precise ignition of all forms of energetics, including liquid and gel energetics. A rigid housing, contains a pyrotechnic in a hermetically sealed environment. The reaction of the pyrotechnic is, substantially and/or completely, confined to the housing. The release of energy creates a hot particulate in which the formation of solids is mitigated or eliminated. The flame is directed down a microcapillary flash tube including a primary front vent and secondary side vents, which generates a more evenly distributed flame spread, and which increases system efficiency and reliability. A redundant dual bridge wire may also be provided for improving ignition reliability. The assembly thereby performs the combined functions of both an igniter and a flash tube and a complete ignition train is provided in a manner that overcomes the limitations of the conventional configurations. High internal chamber pressure is attained, and superheated particulates are delivered through the vented flash tube, thereby creating a sustained regenerative process, while avoiding long ignition delays. The resulting system of the present invention is therefore suitable for operation with liquid and gel propellants.

The housing is preferably formed of a substrate material, for example a silicon substrate. The term "substrate", as used in the present specification, includes, but is not limited to, any of a number of workable substrate materials, for example those commonly employed in the fabrication of semiconductor electronics or MEMS-based components, including silicon, gallium arsenide, and the like. The housing components formed of the silicon substrate are preferably treated with silicon carbide (SiC) in manner consistent with the treatment known to be used for microelectromechanical systems (MEMS), which offers superior chemical stability and advantageous mechanical and thermal properties. The semiconductor substrate material may optionally undergo an initial $SiO_2$ treatment, prior to the SiC treatment. The term "treatment", as used in the present specification, refers to any of a number of techniques for applying silicon carbide (or $SiO_2$ material) to the substrate, which techniques include, for example, coating, layering, impregnating, sputtering, and deposition.

The housing preferably comprises a plurality of body portions that are bonded at an interface. At least one pin may extend between at least two of the body portions for reinforcing the interface. The at least one pin may include tabs that are seated within a internal walls of recesses formed in the at least two body portions, for further reinforcing the interface.

A tube, referred to as a flash tube, can be mounted to the outlet for directing the flame, and side vents can be provided on the flash tube for generating a more evenly distributed flame spread about the flash tube.

In one aspect, the present invention is directed to a pyrotechnic initiator. The initiator includes a housing having an inner chamber and an outlet. A pyrotechnic charge is located within the chamber. The housing is of sufficient mechanical integrity to withstand internal pressure of the pyrotechnic charge when activated, such that the internal pressure is released at the outlet.

The pyrotechnic initiator may further comprise a vent tube in communication with the outlet having a longitudinal primary vent for directing activated pyrotechnic charge from the inner chamber through an entrance aperture of the primary vent to an exit aperture. The pyrotechnic initiator may further include lateral secondary side vents in communication with the longitudinal primary vent for directing activated pyrotechnic charge to the side of the vent tube.

A groove may be formed in an outer surface of the vent tube, and an O-ring positioned in the groove, for providing a barrier to escape of initiated pyrotechnic charge between the outer surface of the vent tube and the outlet. The O-ring preferably deforms upon activation of the pyrotechnic charge to seal a gap between the outer surface of the vent tube and the outlet. The width of the O-ring is preferably less than that of the groove to allow for equal distribution of pressure from the initiated charge across a side surface of the O-ring.

The O-ring may comprise first, second and third sub-O-rings positioned adjacent each other in the groove. The first and third sub-O-rings are positioned on opposite sides of the second O-ring, in which case the first and third sub-O-rings comprise Bakelite and wherein the second O-ring comprises Neoprene.

A bridge wire is included for conducting current to initiate activation of the pyrotechnic charge. In one example the bridge wire comprises first and second redundant bridge wires that may be configured in a cross pattern for distribution of the current through the pyrotechnic charge. First and second contact pins pass through the housing and are electrically coupled to corresponding first and second portions of the bridge wire for delivering current to the bridge wires. A pin seal is provided along at least a portion of the bodies of the first and second pins for sealing the interface between the first and second pins and the housing.

A first moisture barrier may be provided at the entrance aperture of the primary vent, for example comprising a fluoropolymeric seal. A retention sleeve, for example comprising nylon, may be provided in the chamber between the pyrotechnic charge and the vent tube for securing the vent tube in the outlet.

The pyrotechnic charge may comprise a material selected from the group of materials consisting of: cis-bis-(5-nitrotetrazolato)tetraminecobalt(III)perchlorate (BNCP), zirconium potassium perchlorate (ZPP), titanium-hydride-potassium-perchlorate (THPP), and lead azide ($PbN_6$).

In another embodiment, the housing comprises stainless steel of sufficient structural integrity and/or composition so as to contain the energy released by the pyrotechnic charge when activated. The housing may comprise a plurality of body portions that are welded together to form the housing.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 3B is a closeup view of the position of the O-ring prior to activation, while

DETAILED DESCRIPTION OF PREFERRED EMBODIMENTS

Figure 1:
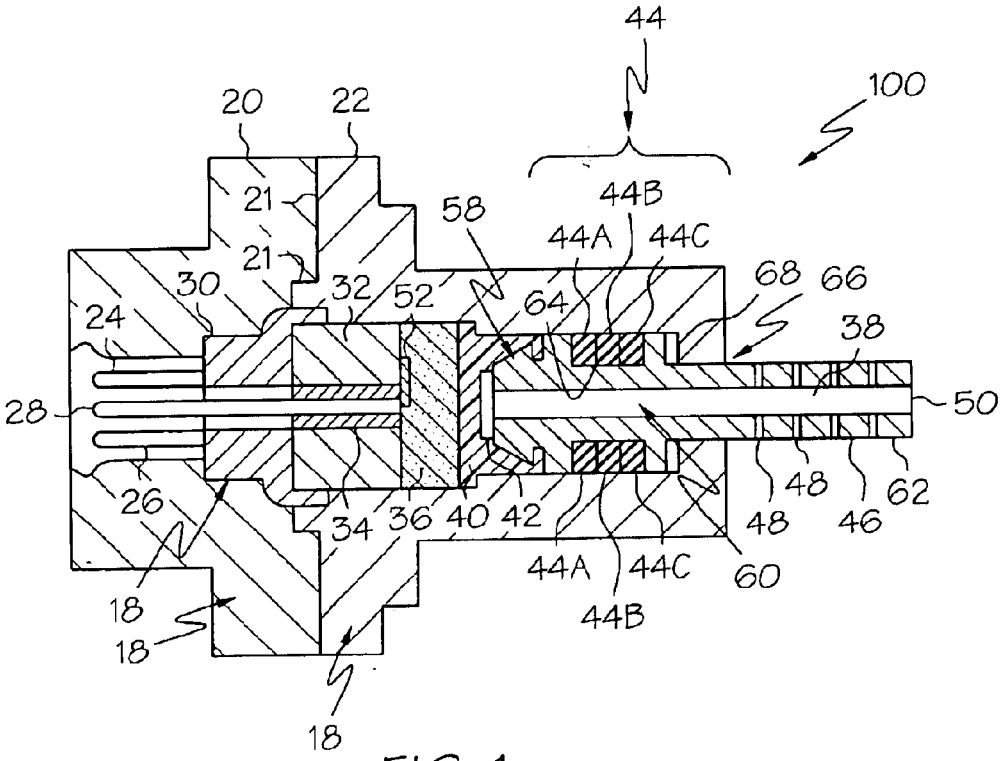
FIG. 1 is a cross-sectional view of a microcapillary initiator configured in accordance with the present invention in a dormant state, prior to activation.

FIG. 1 is a cross-sectional view of a microcapillary initiator configured in accordance with the present invention, in a dormant state, prior to activation. The initiator 100 includes a housing 18, for example formed of stainless steel, of sufficient structural integrity for containing the reaction of the pyrotechnic charge when activated. While the housing 18 may comprise a unitary structure, the housing disclosed in FIG. 1 includes multiple components, for ease of manufacturability and improved reliability. First and second body portions, 20, 22 respectively may be welded together along seam 21. An internal housing 30 is seated within the first body portion 20 and a mating header body 32 is seated within the second body portion. A fluoropolymeric sealant may be provided between the internal housing 30 and the first body 20 to prevent migration of moisture into the reaction cavity. The first and second body portions 20, 22, the internal housing 30, and the header body 32 preferably comprise stainless steel so as to provide for sufficient mechanical integrity for confining the release of energy of the pyrotechnic charge 36 to within the housing, in order to direct the released energy through an exit aperture or outlet 66, for example via vent tube 46.

The outlet end of the housing 18 does not disintegrate upon activation of the pyrotechnic, as in the conventional embodiments. Instead, the energy is confined and focused through the exit aperture 66, or, in the case where the vent tube 46 is employed, through the exit vent 50 and side vents 48.

A ground pin 24 and first and second contact pins 26, 28 pass through the first body 20 and through the internal housing 30 and the header body 32. The contact pins 26, 28 are coupled to the ground pin 24 via a bridge wire 52. The pins 24, 26, 28 and bridge wire 52 are preferably formed of an electrically conductive material that is resistant to corrosion in adverse environments. The bridge wire 52 is preferably insulated from the body of the inner housing and contacts the pyrotechnic charge 36. At activation of the pyrotechnic charge 36, a voltage or current is applied across the ground pin 24 and contact pins 26, 28. The bridge wire operates as a fuse that is shorted by the applied voltage or current, which in turn initiates the pyrotechnic.

Figure 4A:
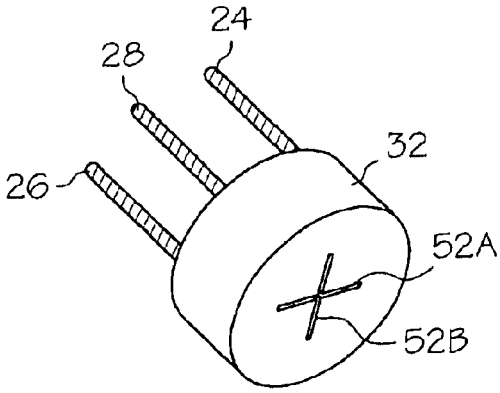
FIG. 4A is a perspective view of the header body illustrating a cross-patterned bridge wire configuration including first and second redundant bridge wires, for improved reliability, in accordance with the present invention.
Figure 4B:
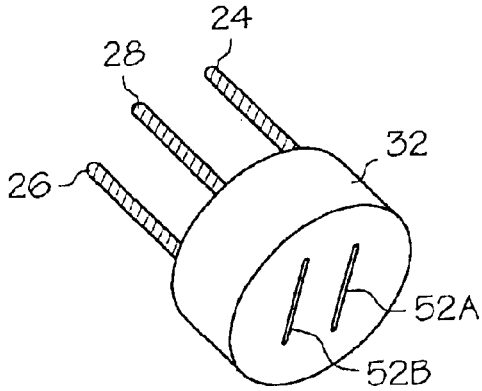
FIG. 4B is a perspective view of the header body illustrating a parallel bridge wire configuration including first and second redundant bridge wires, for improved reliability, in accordance with the present invention.

In one embodiment, the bridge wire 52 comprises redundant first and second bridge wires 52A and 52B for improved reliability in the event of failure of one of the bridge wires. The first and second bridge wires 52A, 52B may be configured in a cross-pattern as shown in FIG. 4A to more evenly distribute the initial activation of the pyrotechnic charge. Alternatively, the redundant bridge wires may be configured in a parallel arrangement, as shown in FIG. 4B. In the case of redundant wires, the first and second bridge wires 52A, 52B are insulated from each other, and from the header body 32. One end of each bridge wire 52A, 52B is connected to a contact pin and the other end is connected to ground, for example a ground pin. The body of the housing, including the header body 32, may be grounded. In a preferred embodiment, the bridge wire comprises platinum.

A glass-to-metal seal 34, for example comprising an epoxy-based thermal plastic elastomer, prevents venting or leakage of the activated pyrotechnic charge gasses from penetrating the rear of the initiator 100 along the bodies of the ground and contact pins 24, 26, 28.

A pyrotechnic charge 36 is located adjacent the header body 32, in direct contact with the bridge wire 52. The pyrotechnic charge 36 may comprise cis-bis-(5-nitrotetrazolato)tetraminecobalt(III)perchlorate, (BNCP), zirconium potassium perchlorate (ZPP), titanium-hydride-potassium-perchlorate (THPP), or lead azide ($PbN_6$).

BNCP is a preferred pyrotechnic, since it is a relatively insensitive energetic and therefore is conducive to manufacturing and shipping of product. It is more stable, yet provides at least twice the impetus, or ballistic potential, of the other listed pyrotechnics, per unit volume. This is an advantage where size reduction and overall energy content are the focus. BNCP further undergoes a deflagration-to-detonation transition in a much shorter column length relative to the other pyrotechnics, and therefore is amenable to use in smaller devices. In addition, the byproducts of BNCP are also less harmful to the environment, relative to the other listed pyrotechnics.

A retention sleeve 40, for example formed of nylon, is positioned adjacent the pyrotechnic charge 36. The sleeve is configured to seat within the second housing body 22, and to mate with, seams formed in a head portion 58 at a proximal end of vent tube 46, in order to secure the tube 46 in a lateral direction with respect to the housing 18.

The vent tube 46 includes a head portion 58, as described above, a body portion 60 and a neck portion 62. The head portion is adapted to mate with the retention sleeve 40, as described above. The body portion 60 is adapted to closely fit within the inner wall of the second housing body 22. A groove 64 is formed in the outer wall of the body portion 60, to provide a seat for an O-ring 44. Details of, and the operation of, the O-ring 44 are described in further detail below.

An exit aperture 66 is formed in an outer wall of the second housing body 22. The neck portion 62 of the vent tube 46 extends through the exit aperture 66. An exit seal 68 may be provided between the neck portion 62 and the inner wall of the second housing body 22 to prevent contaminants from interfering with operation of the O-ring 44.

The vent tube 46 preferably includes a longitudinal primary exit vent 50 for directing the activated pyrotechnic charge 36 to a location external to the initiator 100. Secondary side vents 48 may optionally be included in the neck portion 62 for providing a more evenly distributed burn of the material to be ignited by the released pyrotechnic charge about the neck. The vent tube 46 is preferably formed of stainless steel.

A tube seal 42, for example comprising a fluoropolymeric sealant, prevents moisture and other contaminants that migrate down the capillary 38 of the vent tube 46 from entering the reaction chamber of the pyrotechnic charge.

Figure 2:
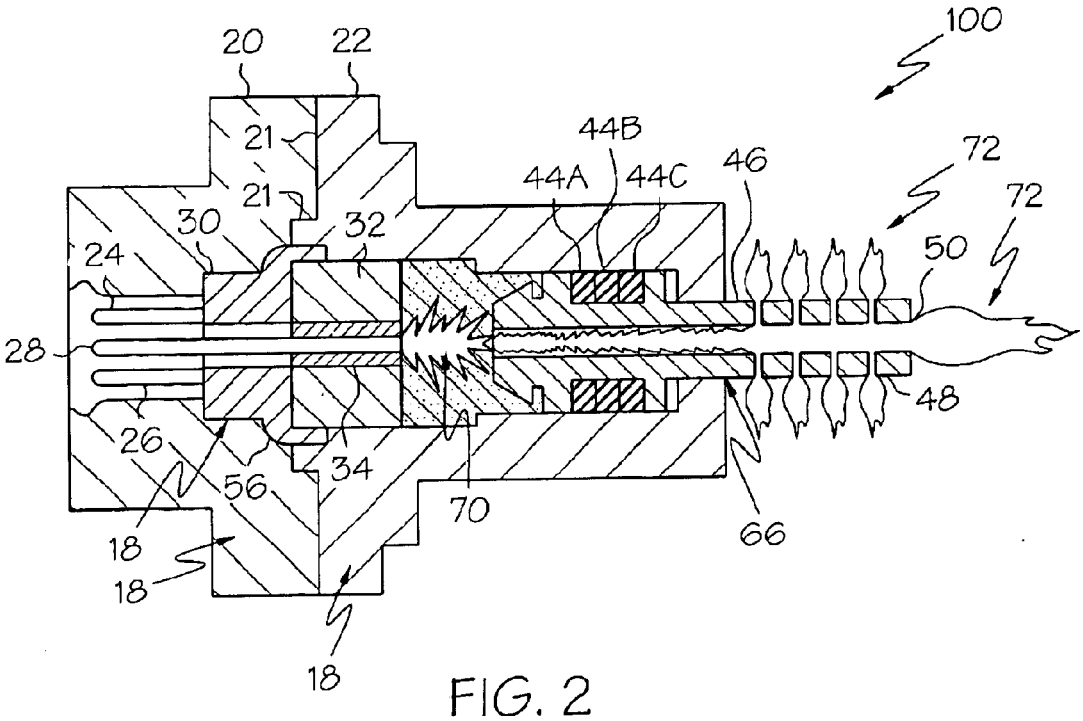
FIG. 2 is a cross-sectional view of the microcapillary initiator of FIG. 1 during activation, in accordance with the present invention.

FIG. 2 is a cross-sectional view of the microcapillary initiator of FIG. 1 immediately following activation of the pyrotechnic charge 36. Current, or voltage, is provided between the ground pin 24 and the first and second contact pins 26, 28. This causes a short circuit to occur across the bridge wire 52, which, in turn, energizes the pyrotechnic charge 36.

The explosion of the pyrotechnic charge 70 is confined by the walls of the housing 18 and focused through the exit aperture 66 or vent tube 46. The explosion is accompanied by superheated gases and particulates, which provide for the resulting flame 72. The released energy causes the nylon retention sleeve 40 and the tube seal 42 to disintegrate. The resulting byproducts are carbon-based and are therefore benign to the generation of the flame 72.

The superheated gases and particulates are directed down the primary exit vent 50 and through the secondary side vents 48 of the vent tube 46. In this manner the ignition flame spread 72 is evenly distributed about the vent tube 46, and fully consumes a material that is exposed to the flame 72, for example a gel or liquid propellant, to provide a controlled burn of the propellant with high reproducibility and high reliability.

The initiator design of the present invention, including the microcapillary vent tube 46, provides for accurate and evenly distributed flame/hot particulate in a pulse type pattern. This is a result of the vented primary flash tube 50, as well as the side vents 48, which promote such even distribution, as a result of hydrodynamic fluid flow characteristics.

During ignition and burn of the pyrotechnic charge 70 superheated gases are released at a high pressure. The O-ring 44 prevents the gas from escaping from the reaction region, a phenomenon referred to in the art as "blow-by", which would otherwise reduce the efficiency and reliability of the burn.

Figure 3A:
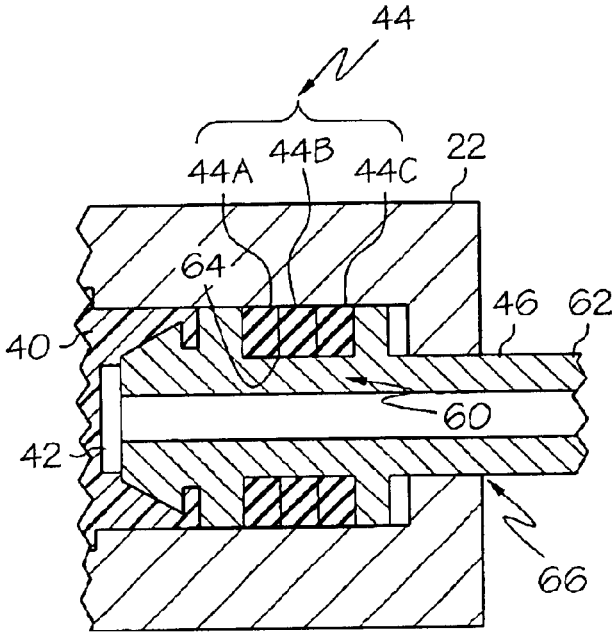
FIG. 3A is a cross-sectional closeup view of the region of the O-ring of the microcapillary initiator of FIG. 1.

In order to prevent or mitigate the occurrence of blow-by, an O-ring 44 is provided in a groove 64 formed in the body portion 60 of the vent tube 46. With reference to the closeup cross-sectional view of FIG. 3A, the O-ring 44 preferably comprises first, second, and third sub-O-rings 44A, 44B, 44C having minimal to no spacing between each other.

Figure 3B:
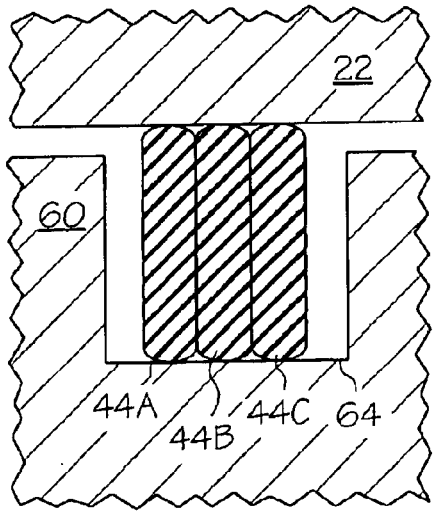

As shown in FIG. 3B, prior to ignition of the pyrotechnic, the first second and third O-rings 44A, 44B, 44C are compressed into the groove 64 formed in the body portion 60 of the vent tube 64. The O-rings 44 are compressed into the groove 84 between the body portion 60 and the inner wall of the second housing body 22. In a preferred embodiment, the first and third sub-O-rings 44A, 44C comprise Bakelite and the second O-ring 44B comprises Neoprene.

At ignition of the pyrotechnic charge, pressure is exerted on the O-rings 44 by the superheated, and contained, gases 70. The applied pressure pushes the O-ring into the gap 72 between the inner wall of the second housing 22 and the body portion 60 of the vent tube, causing the O-ring 44 to obstruct passage of the gas 70. In this configuration, the exerted pressure 70 is preferably evenly distributed along the side portion of the leftmost O-ring 44A to cause the O-rings 44 to be thrust forward and outward and into the gap 72. Otherwise, the pressure may push the O-rings 44 inwardly into the groove 64, out of the way of the gap 72, which would result in blow-by of the gas 70. For this reason, the O-ring groove 64 is preferably wider than the width of the O-ring 44 (or the combined widths of the multiple O-rings 44A, 44B, 44C), as shown in FIG. 3B, in order to allow the pressure to reach the inner portion of the O-ring.

For purposes of the present disclosure, two O-ring designs may be considered, both of which meet the reliability requirements. In a first design, all of the three sub-O-rings 44A, 44B, 44C of the O-Ring 44 do not fail under maximum allowable pressure. In a second design, two of the three sub-O-rings do not fail under the maximum allowable pressure.

Figure 3C:
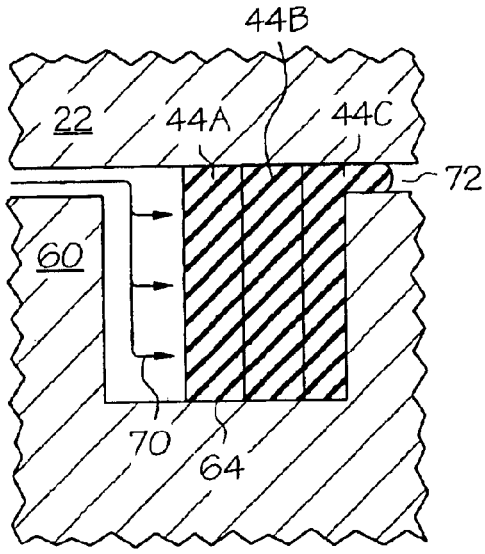
FIG. 3C is a closeup view of the position of the O-ring following activation.

Assume the unreliabilities of the three sub-O-rings in terms of heat content to be:

$$q_1(t)=1-e^{-\lambda_1 t} \quad (1)$$

$$q_2(t)=1-e^{-\lambda_2 t} \quad (2)$$

$$q_3(t)=1-e^{-\lambda_3 t} \quad (3)$$

where $\lambda_1, \lambda_2, \lambda_3$ represent the respective failure rates of each sub-O-Ring 44A, 44B, 44C shown in FIG. 3.

Under the first design, all of the sub-O-rings operate. This is therefore a series system, the reliability G(q(t)) of which is represented by:

$$G(q(t))=1-e^{-\lambda_1 t}e^{-\lambda_2 t}e^{-\lambda_3 t}$$

Differentiating with respect to $\lambda_1$, $\lambda_2$, $\lambda_3$ respectively yields:

$$\delta G(q(t))/\delta\lambda_1=te^{-(\lambda_1+\lambda_2+\lambda_3)t} \quad (4)$$

$$\delta G(q(t))/\delta\lambda_2=te^{-(\lambda_1+\lambda_2+\lambda_3)t} \quad (5)$$

$$\delta G(q(t))/\delta\lambda_3=te^{-(\lambda_1+\lambda_2+\lambda_3)t} \quad (6)$$

Thus, the Lambert function is used to calculate the ratio or percent reliability of each functioning O-ring in the system:

$$(I^i)_{UF}(t)=[\lambda_i te^{-(\lambda_1+\lambda_2+\lambda_3)t}]/[1-^{-(\lambda_1+\lambda_2+\lambda_3)t}] \quad (7)$$

Under the second design, two out of the three sub-O-rings do not fail under maximum pressure. The reliability of this system is represented by:

$$G(q(t))=q_1q_2+q_2q_3+q_3q_1-2q_1q_2q_3 \quad (8)$$

or $$G(q(t))=1-e^{-(\lambda_1+\lambda_2)t}-e^{-(\lambda_1+\lambda_3)t}-e^{-(\lambda_1+\lambda_2)t}-e^{-(\lambda_2+\lambda_3)t}+2e^{-(\lambda_1+\lambda_2+\lambda_3)t} \quad (9)$$

Differentiating with respect to $\lambda_1$, $\lambda_2$, $\lambda_3$ respectively yields:

$$\delta G(q(t))/\delta\lambda_1=te^{-(\lambda_1+\lambda_2)t}+te^{-(\lambda_1+\lambda_3)t}-2te^{-(\lambda_1+\lambda_2+\lambda_3)t} \quad (10)$$

$$\delta G(q(t))/\delta\lambda_2=te^{-(\lambda_1+\lambda_2)t}+te^{-(\lambda_2+\lambda_3)t}-2te^{-(\lambda_1+\lambda_2+\lambda_3)t} \quad (11)$$

$$\delta G(q(t))/\delta\lambda_3=te^{-(\lambda_1+\lambda_3)t}+te^{-(\lambda_2+\lambda_3)t}-2te^{-(\lambda_1+\lambda_2+\lambda_3)t} \quad (12)$$

The Lambert function provides:

$$(I^i)_{UF}(t)=[\lambda_i/G(q(t))][\delta G(q(t))/\delta\lambda_1] \quad (13)$$

where i=1, 2, 3

The multiple-O-ring design, and their location within the initiator, therefore provide for increased reliability and a reduction of gas blow-by during activation of the initiator.

Figure 5A:
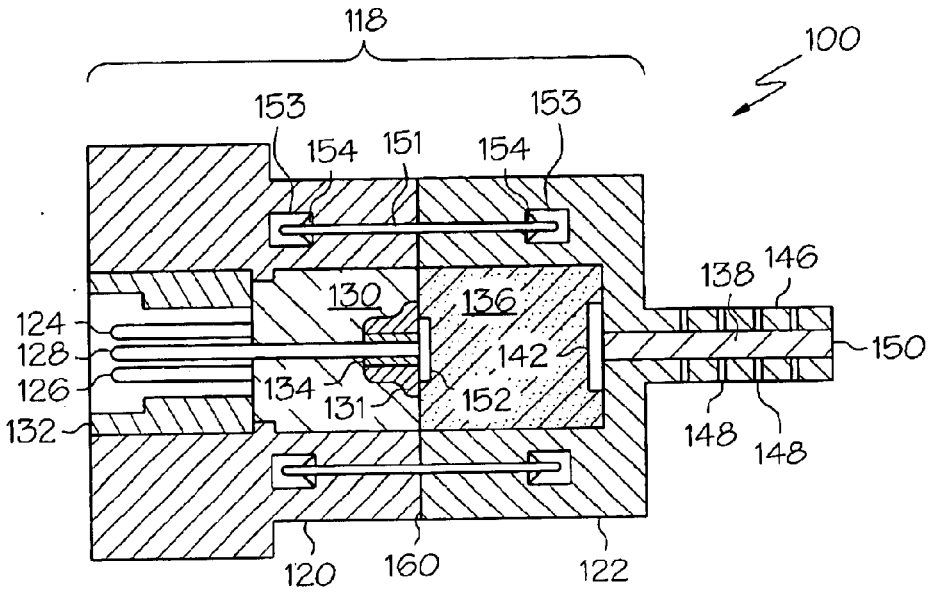
FIG. 5A is a cross-sectional view of a microcapillary initiator having a silicon carbide treated semiconductor housing configured in accordance with the present invention in a dormant state, prior to activation.
Figure 5B:
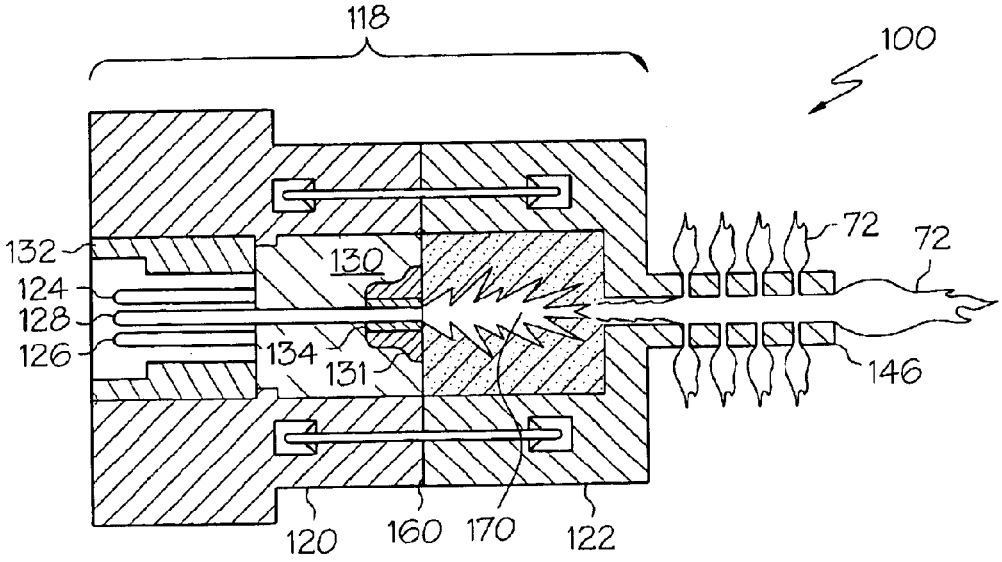
FIG. 5B is a cross-sectional view of the microcapillary initiator of FIG. 5A during activation, in accordance with the present invention.

With reference to FIGS. 5A and 5B, in another embodiment, the pyrotechnic initiator 100 of the present invention includes a housing 118 that is formed from a semiconductor material, for example a silicon-based substrate material. The housing 118 components, including a first body portion 120, a second body portion 122, internal housing portion 130, and cap portion 132 are etched from a silicon-based substrate, or other semiconductor substrate, using standard photolithography techniques. Following formation of the various components, the etched substrate components are coated with silicon carbide, for example by low-temperature chemical vapor deposition, as disclosed in Park, et al., "Reaction intermediate in thermal decomposition of 1,3disilabutane to silicon carbide on Si(111)—Comparative Study of Cs+reactive ion scattering and secondary ion mass spectroscopy", Surface Science, volume 450, pages 117–125, 2000, the content of which is incorporated herein by reference. Silicon Carbide (SiC) coated silicon substrate materials are commonly employed in micro-electromechanical systems (MEMS), since these materials offer superior chemical stability, as well as highly superior physiochemical, thermal, mechanical, and electrical properties, under extreme temperature ranges. In one embodiment, the substrate may be treated with silicon dioxide ($SiO_2$) prior to the SiC treatment. Other substrate materials and material treatment techniques are applicable to the present invention.

The first and second body portions, 120, 122 respectively may be welded together, or otherwise bonded with an adhesive layer, along seam 160. The seam 160 interface is preferably reinforced by retention pins 151, for example comprising nickel plated alloy, that extend through the bodies of the first and second body portions 120, 122. The pins 151 include tabs 154 that are seated against an internal wall of recesses 153 formed in the first body portions 120, 122. The pins 151 and tabs 154 work in combination with the adhesive layer to prevent separation of the first and second body portions 120, 122 upon activation of the initiator.

An internal housing 130 is seated within the first body portion 120 and a mating header body 131 is seated in a recess of the internal housing 130. A fluoropolyniric sealant may be provided between the internal housing 130 and the first body portion 120 to prevent migration of moisture into the reaction cavity. The first and second body portions 120, 122, the internal housing 130, and the header body 131 preferably comprise SiC treated silicon material so as to provide for sufficient thermal and mechanical integrity for confining the release of energy of the pyrotechnic charge 136 to within the housing, in order to direct the released energy through an exit aperture or outlet, for example via vent tube 146.

The outlet end of the housing 118 does not disintegrate upon activation of the pyrotechnic, as in the conventional embodiments. Instead, the energy is confined and focused through the exit aperture, for example in the case where the vent tube 146 is employed, through the exit vent 150 and side vents 148.

As in the aforementioned embodiments, a ground pin 124 and first and second contact pins 126, 128 pass through the first body portion 120 and through the internal housing 130 and the header body 131. The contact pins 126, 128 are coupled to the ground pin 124 via a bridge wire 152. The pins 124, 126, 128 and bridge wire 152 are preferably formed of an electrically conductive material that is resistant to corrosion in adverse environments. The bridge wire 152 is preferably insulated from the body of the inner housing and contacts the pyrotechnic charge 136. At activation of the pyrotechnic charge 136, a voltage or current is applied across the ground pin 124 and contact pins 126, 128. The bridge wire operates as a fuse that is shorted by the applied voltage or current, which in turn initiates the pyrotechnic 136. In a preferred embodiment, the bridge wire 152 comprises redundant first and second bridge wires 152A and 152B for improved reliability, as described above.

As in the aforementioned embodiments, a glass-to-metal seal 134, for example comprising an epoxy-based thermal plastic elastomer, prevents venting or leakage of the activated pyrotechnic charge gasses from penetrating the rear of the initiator 100 along the bodies of the ground and contact pins 124, 126, 128.

The pyrotechnic charge 136 is located adjacent the internal housing 130 and header body 132, in direct contact with the bridge wire 152. Preferred pyrotechnic charge compositions are described above.

The vent tube 146 is preferably integral with the second body portion 122, and formed using standard semiconductor fabrication processes. The vent tube 146 includes a longitudinal primary exit vent 150 for directing the activated pyrotechnic charge 136 to a location external to the initiator 100. Secondary side vents 148 may optionally be included in the neck portion 162 for providing a more evenly distributed burn of the material to be ignited by the released pyrotechnic charge about the neck.

A tube seal 142, for example comprising a silicon carbide sealant, or alternatively, a fluoropolymric sealant, prevents moisture and other contaminants that migrate down the capillary 138 of the vent tube 146 from entering the reaction chamber of the pyrotechnic charge.

FIG. 5B is a cross-sectional view of the microcapillary initiator of FIG. 5A immediately following activation of the pyrotechnic charge 136. As described above in connection with the embodiments of FIGS. 1 and 2, current, or voltage, is provided between the ground pin 124 and the first and second contact pins 126, 128. This causes a short circuit to occur across the bridge wire 152, which, in turn, energizes the pyrotechnic charge 136.

As described above, the explosion 170 of the pyrotechnic charge is confined by the walls of the housing 118 and focused through the vent tube 146. In particular, the silicon carbide treated walls of the housing are capable of withstanding the extreme pressure and temperature generated as a result of activation of the propellant. The explosion is accompanied by superheated gases and particulates, which provide for the resulting flame 172. The released energy causes the tube seal 142 to disintegrate. The resulting byproducts are benign to the generation of the flame 172.

The superheated gases and particulates are directed down the primary exit vent 150 and through the secondary side vents 148 of the vent tube 146. In this manner the ignition flame spread 172 is evenly distributed about the vent tube 146, and fully consumes a material that is exposed to the flame 172, for example a gel or liquid propellant, to provide a controlled burn of the propellant with high reproducibility and high reliability.

The initiator design of the present invention, including the microcapillary vent tube 46, 146 provides for accurate and evenly distributed flame/hot particulate in a pulse type pattern. This is a result of the vented primary flash tube 50, 150 as well as the side vents 48, 148 which promote such even distribution, as a result of hydrodynamic fluid flow characteristics.

During ignition and burn of the pyrotechnic charge 70 superheated gases are released at a high pressure. The O-ring 44 in the embodiment of FIGS. 1 and 2 prevents the gas from escaping from the reaction region, a phenomenon referred to in the art as "blow-by", which would otherwise reduce the efficiency and reliability of the burn.

In this manner, the present invention provides for a highly reliable pyrotechnic ignition system. The mechanical integrity of the reaction chamber ensures that the energy of the reaction is directed to an outlet of the chamber. A vent tube may be provided at the outlet for further directing the released energy to provide a controlled flame spread that is predictable and repeatable. A redundant bridge wire configuration may be provided for improving system reliability. BNCP is preferably employed as the propellant, taking advantage of its stability, reliability, and high output power. The system is therefore well suited for application to ignition of liquid and gel propellants.

As indicated above, in one embodiment of the present invention, the initiator housing components are fabricated from a substrate using standard MEMS fabrication techniques. Any of a number of workable substrate materials may be employed, for example those commonly employed in the fabrication of semiconductor electronics or MEMS-based components, including silicon, gallium arsenide, and the like. However, other substrate materials that are workable in the sense that they can be formed or shaped according to known fabrication techniques, but are not necessarily semiconductor materials, are equally applicable to the principles of the present invention.

In a preferred embodiment of the initiator housing, a silicon substrate is employed and coated with silicon-carbide (SiC), a combination that is commonly utilized in microelectromechanical systems (MEMS) devices. Silicon-based structures treated with SiC provide superior chemical stability, as well as highly superior physicochemical, mechanical, and electrical properties, under extreme temperature ranges, as compared to non-coated silicon-based structures.

The conventional approach for depositing a silicon-carbide film on a silicon substrate is the chemical-vapor deposition (CVD) process. When a mixture of $SiH_4$ and propane is employed at atmospheric pressure in the conventional CVD process, temperatures in excess of 1000° C. are required. Researchers have recently developed a low-temperature CVD process, using DSB (1,3-disilabutane: $CH_3$—$SiH_2$—$CH_2$—$SiH_3$) as a single precursor molecule. (See Park et al., "Reaction intermediate in thermal decomposition of 1,3-disilabutane to silicon carbide on Si(111)—Comparative study of Cs+reactive ion scattering and secondary ion mass spectroscopy", Surface Science, volume 450, pages 117–125, 2000). An embodiment of the present invention utilizes this process to deposit high-quality SiC films on Si-based substrates for forming the housing components.

Optimal housing design requires a selection of material that satisfies, among others, the following criteria: resistance to creep, or deformation over time; resistance to high-temperature oxidation; material toughness; resistance to thermal fatigue; thermal stability; and low density. The initiator housing of this aspect of the present invention exploits the superior properties of SiC at high temperature to realize an optimal material that satisfies, to a high degree, the stated criteria. Silicon has been the nearly exclusive material of choice for MEMS-based structures, due to compatibility with conventional microelectronics fabrication technology. However, the thermal softening material behavior of silicon, renders silicon a sub-optimal material for high-temperature structures.

In the low-temperature CVD SiC deposition process referenced above, several key advantages are realized over the conventional atmospheric-pressure CVD SiC deposition process. For example, in the low temperature approach, high quality polycrystalline films at temperatures as low as 650° C. can be realized, which are compatible with SiC deposition on Si-based MEMS devices. Second, in the conventional atmospheric pressure CVD process, $SiH_4$/propane gas mixture is utilized. Both gases are dangerously explosive. In the low-temperature approach, the precursor, DSB: 1,3-disilabutane: $CH_3$—$SiH_2$—$CH_2$—$SiH_3$, is benign. It is liquid at room temperature, with a vapor pressure of 27 Torr. Third, with a single precursor, the need for complex gas handling systems is reduced in the low-temperature approach. Fourth, the pre-carbonization step for deposition on Si and $SiO_2$ is eliminated in low-temperature approach. Finally in the low-temperature CVD deposition process, SiC films can be patterned using $SiO_2$ masking and simple lift-off, using HF.

Silicon carbide SiC is therefore applicable as a material for the initiator housing of the present invention. SiC creep resistance is outstanding up to 1327° C., and its relatively low expansion and high conductivity provide for resistance to thermal shock, in spite of its relatively low toughness. Chemical Vapor Deposition (CVD) of SiC onto silicon substrates has been identified as a viable option for manufacture. In order to better understand the advantages of SiC, a discussion of the SiC molecule and its structure follows.

Silicon carbide SiC is known as a wide-bandgap semiconductor existing in many different polytypes. All polytypes have a hexagonal frame with a carbon atom situated above the center of a triangle of Si atoms, and underneath, a Si atom belonging to the next layer. The distance, a, between neighboring silicon or carbon atoms is approximately 3.08 Å for all polytypes. The carbon atom is positioned at the center of mass of the tetragonal structure outlined by the four neighboring Si atoms so that the distance between the carbon atom to each of the Si atoms is the same. Geometrical considerations give that this distance, C-Si, is $a\times(3/8)^{1/2}$, i.e., approximately 1.98 Å. The distance between two silicon planes is, thus, $a\times(2/3)^{1/2}$, i.e., approximately 2.52 Å. The height of a unit cell, c, varies between the different polytypes. The ratio c/a , thus, differs from polytype to polytype, but is always close to the ideal for a closed packed structure. This ratio is, for instance, approximately 1.641, 3.271 and 4.908 for the 2H—, 4H— and 6H—SiC polytypes, respectively, whereas the equivalent ideal ratios for these prototypes are $(8/3)^{1/2}$, $2\times(8/3)^{1/2}$ and $3\times(8/3)^{1/2}$, respectively. The difference between the polytypes is the stacking order between succeeding double layers of carbon and silicon atoms.

The three most common polytypes, are referred to as 3C, 6H and 4H. If the first double layer is referred to as the "A" position, the next layer that can be placed according to a closed packed structure would be placed on the B position or the C position. The different polytypes would be constructed by permutations of these three positions. The 3C—SiC polytype is the only cubic polytype and it has a stacking sequence ABCABC . . . , or ACBACB . . . .

A fundamental difference between SiC and silicon is that while silicon grows in one crystalline structure, SiC is stable in approximately 250 different atomic arrangements or polytypes. The specific atomic arrangements of a SiC structure will influence its physical and electrical properties. The three most common SiC polytypes used in microelectronic applications are 6H, 4H, and 3C, 6H and 4H are two different hexagonal structures, or alpha (α) polytypes, and 3C is the only stable cubic structure or beta (β) polytype of SiC. The beta (β) polytype of SiC is the structure being proposed for use in the proposed art. Throughout the present specification, the abbreviation SiC is representative of any or all of the polytypes of interest. In the rare exception where the two alpha polytypes need to be differentiated, 6H—SiC and 4H—SiC are used. β-SiC refers to the cubic polytype in Table 1 below. The table illustrates key electrical characteristics of the three common SiC polytypes and compares them to silicon.

TABLE 1

Comparison of properties os Silicon, β-SiC, 4H-SiC, and 6H SiC (values in parenthesis refer to doped materials)

| | Silicon | β-SiC | 6H-SiC | 4H-SiC |
|---|---|---|---|---|
| Bandgap | 1.1 eV | 2.2 eV | 2.9 eV | 3.2 eV |
| Electron mobility | 1500 $cm^2/Vs$ (1350 $cm^2/Vs$)[1] | 1000 $cm^2/Vs$ | 600 $cm^2/Vs$ (800 $cm^2/Vs$)[1] | (1000 $cm^2Vs$)[1] |
| Hole mobility | 600 $cm^2/Vs$ (450 $cm^2Vs$)[2] | 40 $cm^2/Vs$ | 24 $cm^2Vs$ | (120 $cm^2/Vs$)[2] |
| Breakdown Voltage | $3\times10^5$ V/cm ($6\times10^3$ V/cm)[3] | $40\times10^3$ V/cm | | ($35\times10^3$V/cm)[3] |
| Saturated electron velocity | $1\times10^7$ cm/s | $2.5\times10^7$ cm/s | $2\times10^7$cm/s | $2\times10^7$ cm/s |
| Thermal conductivity | 1.5 W/cmK | 5 W/cmK | 5 W/cmK | 5 W/cmK |

A second, important, difference between silicon and all three SiC polytypes is the larger bandgap of SiC. The bandgap of a semiconductor is the energy difference between the bottom of the conduction band and the top of the valence band. The bandgap determines the minimum energy required to excite an electron from the valence band to the conduction band. A "Wide" bandgap is defined as a bandgap greater than the 1.1 eV bandgap of silicon, and thus SiC is classified as a wide bandgap semiconductor. The use of a semiconductor in electronic devices is dependent upon the ability to control the electron and hole (i.e. charge carrier) movement through the material. The existence of the bandgap and the ability to control the movement of electrons from the valence band to the conduction band where they are mobile is an essential foundation of electronic devices, and is critical in the choice of material for MEMS-based construction.

For silicon, with a bandgap of 1.1 eV, temperatures greater than approximately 250° C. are sufficient to thermally excite electrons across the energy barrier of the bandgap, to populate the conduction band, and to cause a loss of controlled device operation. A relatively larger bandgap enables SiC-based electronic devices to operate in higher temperature environments than silicon-based electronic devices, because the wide bandgap of SiC provides a greater energy barrier to the thermal excitation of the atoms. SiC-based devices have demonstrated long-term operability above 350° C., have successfully functioned to 700° C. and have demonstrated operation as a capacitor at 1000° C. Replacing silicon devices with SiC devices reduces weight and space requirements, since external thermal, or mechanical, systems for mitigating stress-induced effects are not required. Furthermore, SiC devices improve system reliability for high-temperature applications such as the initiator housing of the present invention.

Due to temperature sensitivity, silicon-based devices used in high-temperature applications are contained in environmentally controlled systems, which can be quite sophisticated. Because SiC is capable of operation at much higher temperatures and can withstand more radiation than silicon, the weight of the radiation shielding required for power devices based on SiC materials is reduced.

Generally speaking, the combination of high electric breakdown field, high saturated electron drift velocity, and high thermal conductivity makes SiC an appropriate material for the enclosures of the initiator housing of the present invention. A high breakdown field allows the material to withstand the demands of high power applications. The combination of a high breakdown field and a wide bandgap means that SiC devices are able to operate under higher power conditions than silicon, and also, because of the wide band gap, can be heavily doped and still maintain a desired breakdown voltage. This allows production of devices that meet the required breakdown voltage, with higher efficiencies and faster speeds than equivalent silicon-based devices.

For high-power, high-frequency applications, the higher the electron mobility of the material, the better the performance that can be achieved in devices. The electron mobility in β-SiC is greater than the electron mobility in β-SiC because of reduced phonon scattering in the cubic material. Thus β-SiC would perform better than α-SiC in applications where the highest possible electron mobility is required. Once again, SiC material properties offer higher performance than silicon. The combination of high thermal conductivity and high breakdown field of the SiC material also means that a higher density of integrated devices can be made with SiC than with silicon. This enables smaller electronics packaging and lighter weight for final products. Smaller and lighter products bring economic and operability advantages to most applications.

SiC differs from silicon in several mechanical properties as well. SiC has a Knoop hardness of 2480 kg/mm$^2$, as compared to 850 kg/mm$^2$ for silicon, and wear resistance value of 9.15 compared to the 10 of diamond. SiC has a higher Young's modulus (700 GPa) than Si (190 GPa). SiC also resists chemical attacks more than silicon, is not etched by most acids, and demonstrates greater radiation resistance than silicon. These properties make SiC better suited for highly erosive or corrosive environments than silicon, for example in the initiator application of the present invention.

Film growth is an integral part of semiconductor device fabrication and is influenced by atomic arrangements. The arrangement of atoms in the substrate, the solid crystal on which the film is formed, influences the arrangement of atoms in the crystalline film grown on top of it.

For a material like SiC with 250 polytypes, that means different substrates will encourage the growth of different polytypes of SiC. Two examples of situations where the arrangement of SiC atoms is important are MEMS processing and gallium nitride (GaN) film growth. For MEMS applications in harsh erosive, corrosive, and/or high temperature environments, β-SiC is preferred over α-SiC because the polycrystalline cubic SiC structure can be grown on silicon, silicon dioxide, and silicon nitride. This simplifies MEMS fabrication and integration into silicon-based packages. β-SiC is also a promising substrate for the cubic form of GaN.

As described above, the process of fabricating a MEMS-based initiator housing in accordance with the present invention utilizes the widely-used semiconductor fabrication process of Chemical Vapor Deposition (CVD). CVD is a series of chemical reactions which transform gaseous molecules (precursors) into solid material in the form of thin film or powder, on the surface of a substrate. The CVD process constitutes the following steps: 1) Vaporization and transport of precursor molecules into the reactor; 2) Diffusion of precursor molecules to the surface; 3) Adsorption of precursor molecules to the surface; 4) Decomposition of precursor molecules on the surface and incorporation into sold films; and 5) Recombination of molecular by-products and desorption into gas phase.

The process begins with a single-crystal silicon ingot, grown in, for example, a Czochralski crystallizer, then sliced into wafers. Wafers are chemically and physically polished. The polished wafers serve as the base material (substrate) for devices, as in the case of the MEMS-based initiator housing of the present invention, where processing the silicon wafer begins with the formation of an optional silicon dioxide ($SiO_2$) layer on top of the silicon wafer substrate. The optional $SiO_2$ layer may be formed either by oxidizing the top silicon layer or by providing a $SiO_2$ layer through chemical vapor deposition (CVD).

The wafer is next masked with a polymer photoresist (PR), and the pattern to be etched onto the optional $SiO_2$ layer is placed over the PR, where the wafer is exposed to ultraviolet irradiation. If the mask is a positive photoresist, the ultraviolet light causes scission in the polymer, so that the exposed areas will dissolve when the wafer is placed in the developer (components are likely to require negative photoresist). On the other hand, when a negative photoresist is exposed to ultraviolet irradiation, cross-linking of the polymer chains occurs and the unexposed areas dissolve in the developer. In either case, the undeveloped portion of the photoresist serves to protect the covered areas from etching. Once the exposed areas of $SiO_2$ are etched to form trenches (either by means of wet etching or plasma etching), the remaining PR is removed.

Next the wafer is placed in a furnace containing gas molecules of the desired dopant 1,3-DSB precursor, and CVD SiC is carried out. SiC is then diffused into the exposed surface of the silicon substrate. After diffusion of the dopant into the desired depth in the wafer, it is removed and then covered with $SiO_2$ film, for example by a CVD process. The sequence of masking, etching, CVD, and metallization continues until the desired device is formed.

During the CVD—SiC deposition process, it is important to maintain as low a reactant variation as possible. In some cases, it may be necessary to reduce the flow velocity of the reactant species in order to ensure a complete reaction and perfect film thickness. In others, it may be necessary to increase flow velocity of the reactant species and to introduce turbulence, in order to enhance the reaction on the surface of the substrate. Different applications call for different reaction chamber configurations.

In considering initiator housing design according to the present invention, it should be considered that different phenomena are important at different pressure and temperature ranges. For industrial-scale reactors, the commercial deposition process should combine high reaction rates with well-defined microcrystallinity, phase composition, and uniformity concerning layer thickness. A typical reactor would operate at 800–1050° C. with a yield of 92%, especially at very-low pressures. Reaction time is in the range of 2 hrs, after which a thickness of 50 micron of SiC is achieved. Normally a laminar flow is preferred in a LPCVD reactor in order to keep the lower Peclet number to ensure uniform thickness along the length of the reactor.

While this invention has been particularly shown and described with references to preferred embodiments thereof, it will be understood by those skilled in the art that various changes in form and details may be made herein without departing from the spirit and scope of the invention as defined by the appended claims

We claim:

1. A pyrotechnic initiator comprising:

a housing comprising a substrate material that is formed to have an inner chamber and an outlet, the housing comprising a plurality of body portions that are assembled to form the housing; and a pyrotechnic charge within the inner chamber, the housing substantially encompassing the inner chamber including the pyrotechnic charge, wherein the housing is of sufficient mechanical integrity to withstand internal pressure of the pyrotechnic charge when activated, such that the internal, pressure is released at the outlet.

2. The pyrotechnic initiator of claim 1 further comprising a vent tube in communication with the outlet having a longitudinal primary vent for directing activated pyrotechnic charge from the inner chamber through an entrance aperture of the primary vent to an exit aperture.

3. The pyrotechnic initiator of claim 2 further comprising lateral secondary side vents in communication with the longitudinal primary vent for directing activated pyrotechnic charge to the side of the vent tube.

4. The pyrotechnic initiator of claim 2 wherein the vent tube is integral with the housing.

5. The pyrotechnic initiator of claim 1 wherein the substrate material comprises a semiconductor substrate.

6. The pyrotechnic initiator of claim 5 wherein the semiconductor substrate is silicon treated with silicon carbide (SiC).

7. The pyrotechnic initiator of claim 6 wherein the semiconductor substrate is treated with $SiO_2$ prior to the SiC treatment.

8. The pyrotechnic initiator of claim 1 wherein the housing is hermetically sealed.

9. The pyrotechnic initiator of claim 1 further comprising a bridge wire for conducting current to initiate activation of the pyrotechnic charge.

10. The pyrotechnic initiator of claim 9 wherein the bridge wire comprises first and second redundant bridge wires.

11. The pyrotechnic initiator of claim 10 wherein the first and second redundant bridge wires are configured in a cross pattern for distribution of the current through the pyrotechnic charge.

12. The pyrotechnic initiator of claim 9 further comprising first and second contact pins passing through the housing and electrically coupled to corresponding first and second portions of the bridge wire for delivering current to the bridge wire.

13. The pyrotechnic initiator of claim 12 further comprising a pin seal along at least a portion of the bodies of the first and second pins for sealing the interface between the first and second pins and the housing.

14. The pyrotechnic initiator of claim 2 further comprising a first moisture barrier at the entrance aperture of the primary vent.

15. The pyrotechnic initiator of claim 14 wherein the first moisture barrier comprises a fluoropolymeric seal.

16. The pyrotechnic initiator of claim 1 wherein the pyrotechnic charge comprises a material selected from the group of materials consisting of:

cis-bis-(5-nitrotetrazolato)tetraminecobalt(III)perchlorate (BNCP), zirconium potassium perchlorate (ZPP), titanium-hydride-potassium-perchlorate (THPP), and lead azide ($PbN_6$).

17. The pyrotechnic initiator of claim 1 wherein the plurality of body portions are bonded at an interface to form the housing.

18. The pyrotechnic initiator of claim 17 further comprising at least one pin extending into at least two body portions for reinforcing the interface.

19. The pyrotechnic initiator of claim 18 wherein the at least one pin includes tabs that are seated within internal walls of recesses formed in the at least two body portions for further reinforcing the interface.

20. A pyrotechnic initiator comprising:

a housing comprising a substrate material that is formed to have an inner chamber and an outlet;

a pyrotechnic charge within the inner chamber, the housing substantially encompassing the inner chamber including the pyrotechnic charge; and a vent tube in communication with the outlet having a longitudinal primary vent for directing activated pyrotechnic charge from the inner chamber through an entrance aperture of the primary vent to an exit aperture, wherein the housing is of sufficient mechanical integrity to withstand internal pressure of the pyrotechnic charge when activated, such that the internal pressure is released at the outlet.

21. The pyrotechnic initiator of claim 20 further comprising lateral secondary side vents in communication with the longitudinal primary vent for directing activated pyrotechnic charge to the side of the vent tube.

22. The pyrotechnic initiator of claim 20 wherein the substrate material comprises a semiconductor substrate.

23. The pyrotechnic initiator of claim 22 wherein the semiconductor substrate is silicon treated with silicon carbide (SiC).

24. The pyrotechnic initiator of claim 23 wherein the semiconductor substrate is treated with $SiO_2$ prior to the SiC treatment.

25. The pyrotechnic initiator of claim 20 wherein the housing is hermetically sealed.

26. The pyrotechnic initiator of claim 20 further comprising a bridge wire for conducting current to initiate activation of the pyrotechnic charge.

27. The pyrotechnic initiator of claim 26 wherein the bridge wire comprises first and second redundant bridge wires.

28. The pyrotechnic initiator of claim 27 wherein the first and second redundant bridge wires are configured in a cross pattern for distribution of the current through the pyrotechnic charge.

29. The pyrotechnic initiator of claim 26 further comprising first and second contact pins passing through the housing and electrically coupled to corresponding first and second portions of the bridge wire for delivering current to the bridge wire.

30. The pyrotechnic initiator of claim 29 further comprising a pin seal along at least a portion of the bodies of the first and second pins for sealing the interface between the first and second pins and the housing.

31. The pyrotechnic initiator of claim 20 further comprising a first moisture barrier at the entrance aperture of the primary vent.

32. The pyrotechnic initiator of claim 31 wherein the first moisture barrier comprises a fluoropolymeric seal.

33. The pyrotechnic initiator of claim 20 wherein the pyrotechnic charge comprises a material selected from the group of materials consisting of:

cis-bis-(5-nitrotetrazolato)tetraminecobalt(III)perchlorate (BNCP), zirconium potassium perchlorate (ZPP), titanium-hydride-potassium-perchlorate (THPP), and lead azide ($PbN_6$).

34. The pyrotechnic initiator of claim 20 wherein the housing comprises a plurality of body portions that are bonded at an interface to form the housing.

35. The pyrotechnic initiator of claim 34 further comprising at least one pin extending into at least two body portions for reinforcing the interface.

36. The pyrotechnic initiator of claim 35 wherein the at least one pin includes tabs that are seated within internal walls of recesses formed in the at least two body portions for further reinforcing the interface.

37. A pyrotechnic initiator comprising:

a housing comprising a substrate material that is formed to have an inner chamber and an outlet; and a pyrotechnic charge comprising cis-bis-(5-nitrotetrazolato)tetraminecobalt(III) perchlorate (BNCP) within the inner chamber, the housing substantially encompassing the inner chamber including the pyrotechnic charge wherein the housing is of sufficient mechanical integrity to withstand internal pressure of the BNCP pyrotechnic charge when activated, such that the internal pressure is released at the outlet.

38. The pyrotechnic initiator of claim 37 further comprising a vent tube in communication with the outlet having a longitudinal primary vent for directing activated pyrotechnic charge from the inner chamber through an entrance aperture of the primary vent to an exit aperture.

39. The pyrotechnic initiator of claim 38 further comprising lateral secondary side vents in communication with the longitudinal primary vent for directing activated pyrotechnic charge to the side of the vent tube.

40. The pyrotechnic initiator of claim 37 further comprising a bridge wire for conducting current to initiate activation of the pyrotechnic charge.

41. The pyrotechnic initiator of claim 40 wherein the bridge wire comprises first and second redundant bridge wires.

42. The pyrotechnic initiator of claim 41 wherein the first and second redundant bridge wires are configured in a cross pattern for distribution of the current through the pyrotechnic charge.

43. The pyrotechnic initiator of claim 41 wherein the first and second redundant bridge wires are configured in parallel for distribution of the current through the pyrotechnic charge.

44. The pyrotechnic initiator of claim 37 wherein the substrate material comprises a semiconductor substrate.

45. The pyrotechnic initiator of claim 44 wherein the semiconductor substrate is silicon treated with silicon carbide (SiC).

46. The pyrotechnic initiator of claim 45 wherein the semiconductor substrate is treated with $SiO_2$ prior to the SiC treatment.

* * * * *